US007604384B2

(12) United States Patent
Peck

(10) Patent No.: US 7,604,384 B2
(45) Date of Patent: Oct. 20, 2009

(54) LED ILLUMINATION DEVICE WITH A SEMICIRCLE-LIKE ILLUMINATION PATTERN

(75) Inventor: John P. Peck, Manasquan, NJ (US)

(73) Assignee: Dialight Corporation, Farmingdale, NJ (US)

( * ) Notice: Subject to any disclaimer, the term of this patent is extended or adjusted under 35 U.S.C. 154(b) by 245 days.

(21) Appl. No.: 11/620,968

(22) Filed: Jan. 8, 2007

(65) Prior Publication Data

US 2007/0133213 A1 Jun. 14, 2007

Related U.S. Application Data

(63) Continuation-in-part of application No. 11/069,989, filed on Mar. 3, 2005, now Pat. No. 7,160,004.

(51) Int. Cl.
*F21V 33/00* (2006.01)

(52) U.S. Cl. ..... 362/517; 362/545; 362/297; 362/304; 362/346

(58) Field of Classification Search ..... 362/247, 362/297, 302, 304, 346, 347, 516–519, 545, 362/800
See application file for complete search history.

(56) References Cited

U.S. PATENT DOCUMENTS

| | | | | |
|---|---|---|---|---|
| 4,268,799 | A | 5/1981 | McCrickerd | |
| 4,929,866 | A | 5/1990 | Murata et al. | |
| 5,136,483 | A | 8/1992 | Schoniger et al. | |
| 5,272,570 | A | 12/1993 | Yoshida et al. | |
| 5,642,933 | A | 7/1997 | Hitora | |
| 5,769,532 | A | 6/1998 | Sasaki | |
| 5,800,051 | A | 9/1998 | Gampe et al. | |
| 5,929,788 | A | 7/1999 | Vukosic | |
| 6,948,836 | B2 * | 9/2005 | Ishida et al. | 362/516 |
| 7,078,700 | B2 | 7/2006 | Chandhok et al. | |
| 7,160,004 | B2 | 1/2007 | Peck | |
| 2003/0169599 | A1 | 9/2003 | Natsume | |
| 2003/0193807 | A1 | 10/2003 | Rizkin et al. | |
| 2004/0042212 | A1 | 3/2004 | Du et al. | |
| 2005/0276061 | A1 * | 12/2005 | Repetto et al. | 362/516 |
| 2006/0262551 | A1 * | 11/2006 | Fallahi et al. | 362/518 |

FOREIGN PATENT DOCUMENTS

| | | | |
|---|---|---|---|
| DE | 10 2004 001 052 | A1 | 11/2004 |
| EP | 1 357 332 | A2 | 10/2003 |
| EP | 1 411 291 | A2 | 4/2004 |
| JP | 2004341067 | | 12/2004 |
| WO | WO 01/86198 | | 11/2001 |

* cited by examiner

*Primary Examiner*—Laura Tso
(74) *Attorney, Agent, or Firm*—Oblon, Spivak, McClelland, Maier & Neustadt, L.L.P.

(57) ABSTRACT

An LED (light emitting diode) illumination device that can generate a non-circular light output illumination intensity pattern. The illumination source including a reflector with a conic or conic-like shape. Further, an LED is positioned at approximately 90° with respect to a central axis of the reflector.

22 Claims, 5 Drawing Sheets

LED ILLUMINATION DEVICE WITH A SEMICIRCLE-LIKE ILLUMINATION PATTERN

CROSS-REFERENCE TO RELATED APPLICATIONS

The present patent document is a continuation-in-part of U.S. application Ser. No. 11/069,989 filed on Mar. 3, 2005, the entire contents of which is hereby incorporated herein by reference.

BACKGROUND OF THE INVENTION

Field of the Invention

The present invention is directed to an LED (light emitting diode) illumination device that creates a semicircle-like shaped illumination/intensity pattern.

BACKGROUND OF THE INVENTION

Generally, light sources emit light in a spherical pattern. Light emitting diodes (LEDs) are unique in that they emit light into a hemispherical pattern. Therefore, to utilize an LED as a light source conventionally reflectors are placed in front of an LED.

FIG. 1 shows a background LED illumination device 10 including an LED 1 and a reflector 11. In the background LED illumination device in FIG. 1 the LED 1 and reflector 11 are oriented along the same axis 12, i.e. along a central optical axis 12 of the reflector 11, and the LED 1 points directly out of the reflector 11 along the axis 12.

With the LED illumination device 10 in FIG. 1, wide-angle light is redirected off of the reflector 11 and narrow angle light directly escapes. The result is that the output of the LED illumination device 10 is a narrower and more collimated beam of light. Thereby, with such an LED illumination device 10, a circular-based illumination pattern is created.

SUMMARY OF THE INVENTION

The present inventor recognized that in certain applications, such as in wall-mounted lights, it would be advantageous to create a non-circular pattern to direct light at a floor, and not waste light on a wall, as an example.

As another example of an application in which it would be advantageous to create a non-circular pattern, in certain applications an illumination or intensity distribution may be desired that is broader in one direction than another direction. Automotive lighting applications such as head lamps, turn signals, or tail lamps are examples of such applications. As an example an automotive tail lamp has a desired intensity distribution that is much wider in a horizontal plane than a vertical plane. Such a type of light pattern may be referred to as a long-and-narrow distribution.

Other applications may also benefit from creating a non-circular light output illumination/intensity pattern.

Accordingly, one object of the present invention is to provide a novel LED illumination device that can generate a non-circular light output illumination/intensity pattern.

The present invention achieves the above-noted result by providing a novel illumination source including a reflector with a conic or conic-like shape. Further, a light emitting diode (LED) is positioned at approximately 90° with respect to a central axis of the reflector.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 2:
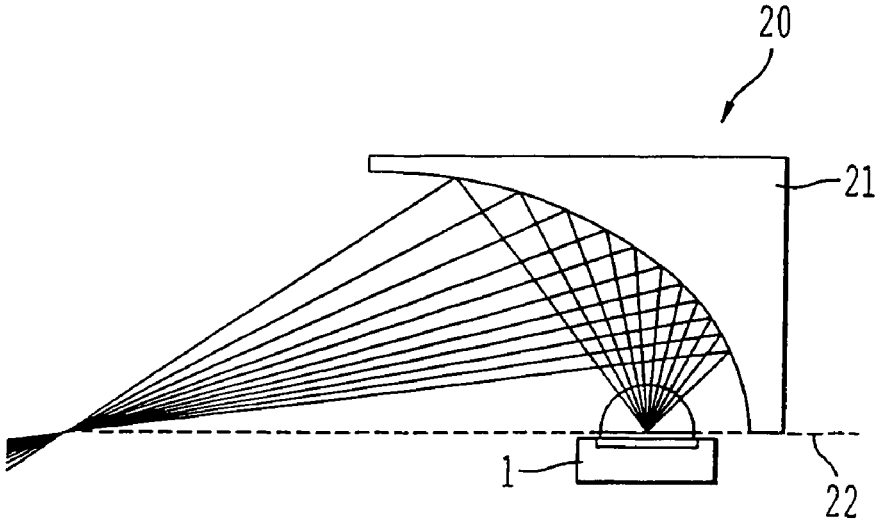
FIG. 2 shows an LED illumination device according to an embodiment of the present invention.

Referring now to the drawings, wherein like reference numerals designate identical or corresponding parts throughout the several views, and more particularly to FIG. 2 thereof, an embodiment of an LED illumination device 20 of the present invention is shown.

As shown in FIG. 2, an LED illumination device 20 of the present invention includes an LED light source 1 and a reflector 21. In the embodiment of the present invention shown in FIG. 2, the LED 1 is rotated approximately 90°, and preferably 90°±30°, off-axis with respect to the reflector 21, i.e. rotated approximately 90° with respect to a central optical axis 22 of the reflector 21. Such an orientation creates an output semicircle based illumination/intensity light pattern.

As noted above with respect to FIG. 1, a background LED illumination device 10 has the LED 1 and the reflector 11 approximately oriented along a same central axis. The result is generation of a circular-based illumination/intensity pattern.

Figure 1:
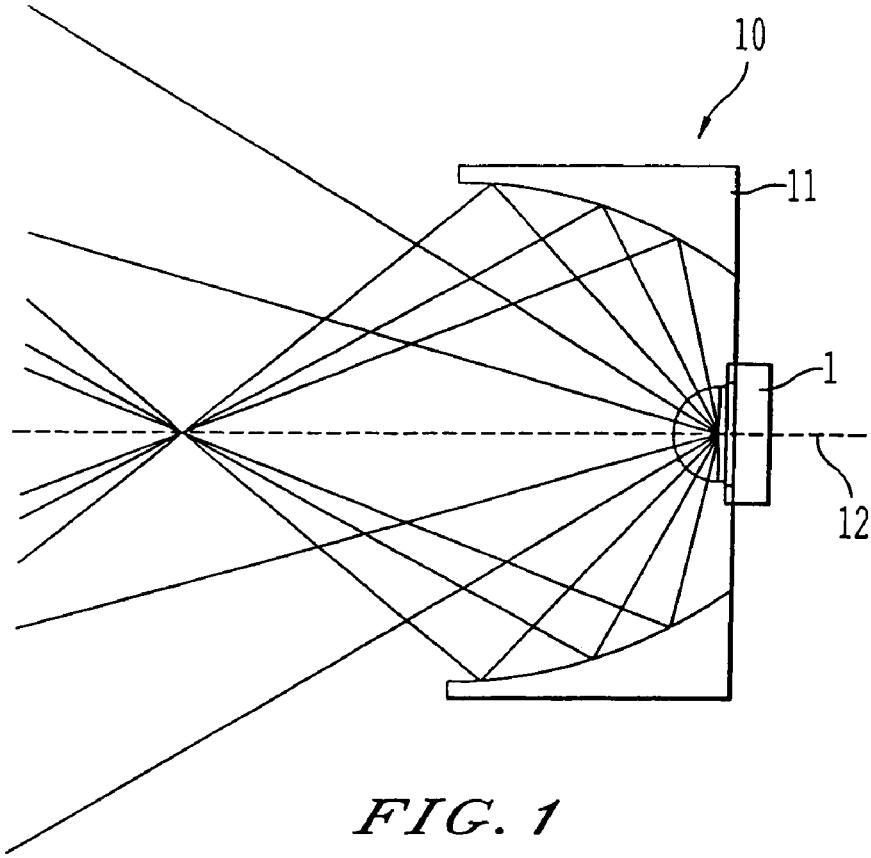
FIG. 1 PRIOR ART
FIG. 1 shows a background art LED illumination device.

In contrast to such a background structure such as in FIG. 1, in the embodiment in FIG. 2 the LED 1 is rotated at approximately 90°, with respect to the central axis 22 of the reflector 21 to create a semicircle-based illumination/intensity pattern.

To create the semicircle-like light output intensity pattern, the reflector 21 has a conic or conic-like shape. The reflector 21 can take the shape of any conic including a hyperbola, a parabola, an ellipse, a sphere, or a modified conic.

The reflector 21 may be formed of a typical hollowed reflecting surface. If the reflector 21 is a typical hallowed reflecting surface, it can be formed of a metal, a metalized surface, or another reflectorized surface.

Figure 3:
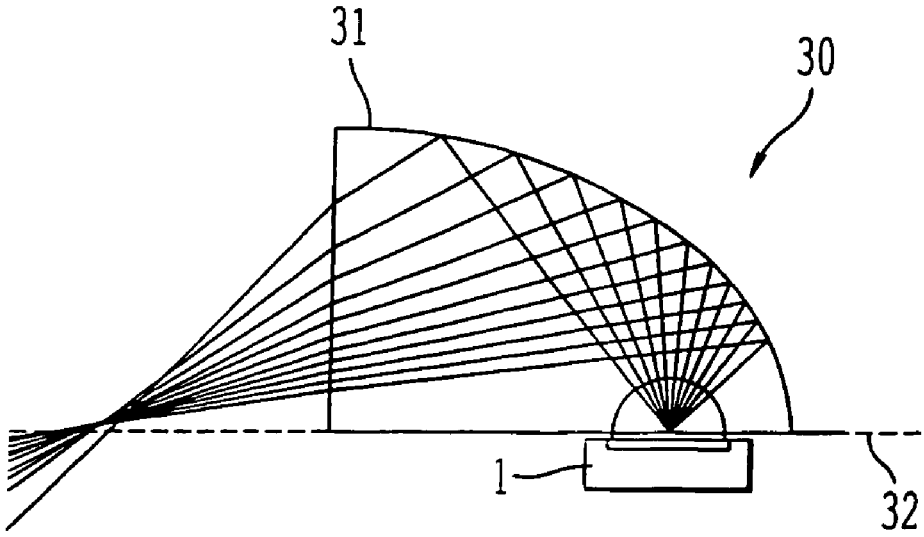
FIG. 3 shows an LED illumination device according to a further embodiment of the present invention.

Or, in a further embodiment of the present invention as shown in FIG. 3, an illumination device 30 can include a reflector 31 made of a solid glass or plastic material that reflects light through total internal reflection, with the LED 1 still offset approximately 90° with respect to the central axis 32 of the reflector 31.

Figure 4:
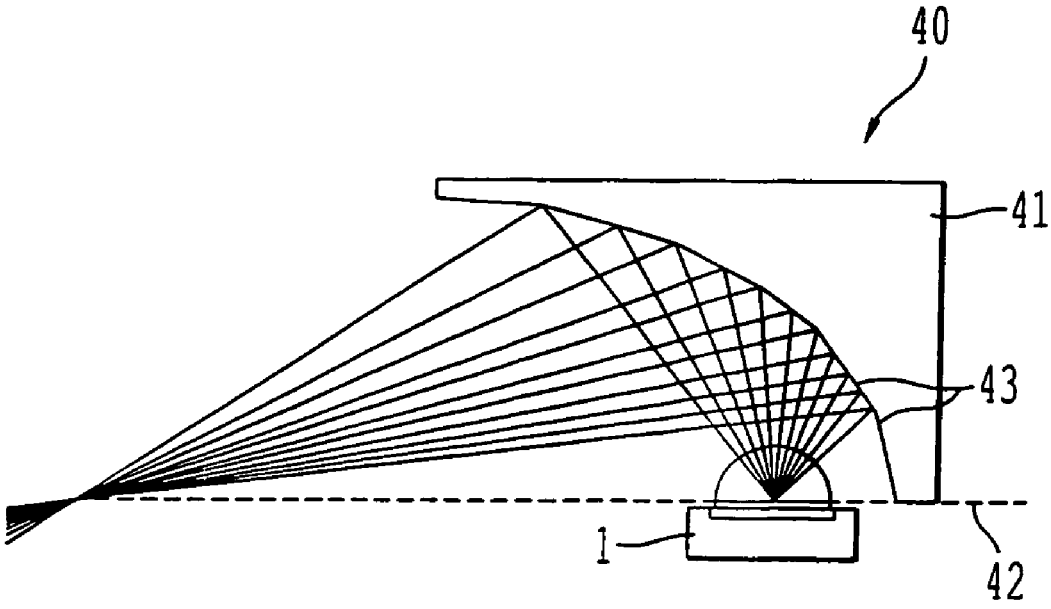
FIG. 4 shows an LED illumination device according to a further embodiment of the present invention.

In a further embodiment of the present invention as shown in FIG. 4, an illumination device 40 can include a reflector 41 with a surface having segmented or faceted conic-reflector surfaces 43. That illumination device 40 still includes an LED 1 offset approximately 90° with respect to the central axis 42 of the reflector 41.

Choosing the specific shape of any of the reflectors 21, 31, 41 can change the illumination/intensity pattern generated by the LED illumination device 20. As noted above, the reflectors 21, 31, 41 each have a conic or conic-like shape to realize a semicircle-based illumination/intensity pattern.

Conic shapes are used commonly in reflectors and are defined by the function:

$$z = \frac{cr^2}{1 + \sqrt{1 - (1+k)c^2r^2}} \quad (1)$$

$$r^2 = x^2 + y^2$$

where x, y, and z are positions on a typical 3-axis system, k is the conic constant, and c is the curvature. Hyperbolas (k<−1), parabolas (k=−1), ellipses (−1<k<0), spheres (k=0), and oblate spheres (k>0) are all forms of conics. The reflectors, 11, 21 shown in FIG. 1 and FIG. 2 were created using k=−0.55 and c=0.105. FIG. 2 shows the reflector 21 used in the present embodiments of the present invention. Changing k and c will change the shape of the illumination/intensity pattern. The pattern may thereby sharpen or blur, or may also form more of a donut or 'U' shape, as desired.

One can also modify the basic conic shape by using additional mathematical terms. An example is the following polynomial:

$$z = \frac{cr^2}{1 + \sqrt{1 - (1+k)c^2r^2}} + F \quad (2)$$

where F is an arbitrary function, and in the case of an asphere F can equal $$\sum_{n=2}^{10} C_{2n} r^{2n},$$

in which C is a constant.

Conic shapes can also be reproduced/modified using a set of points and a basic curve such as spline fit, which results in a conic-like shape for the reflectors 21, 31, 41.

Thereby, one of ordinary skill in the art will recognize that the desired illumination/intensity pattern output by the illumination devices 20, 30, 40 can be realized by modifications to the shape of the reflector 21, 31, 41 by modifying the above-noted parameters such as in equations (1), (2).

Figure 5:
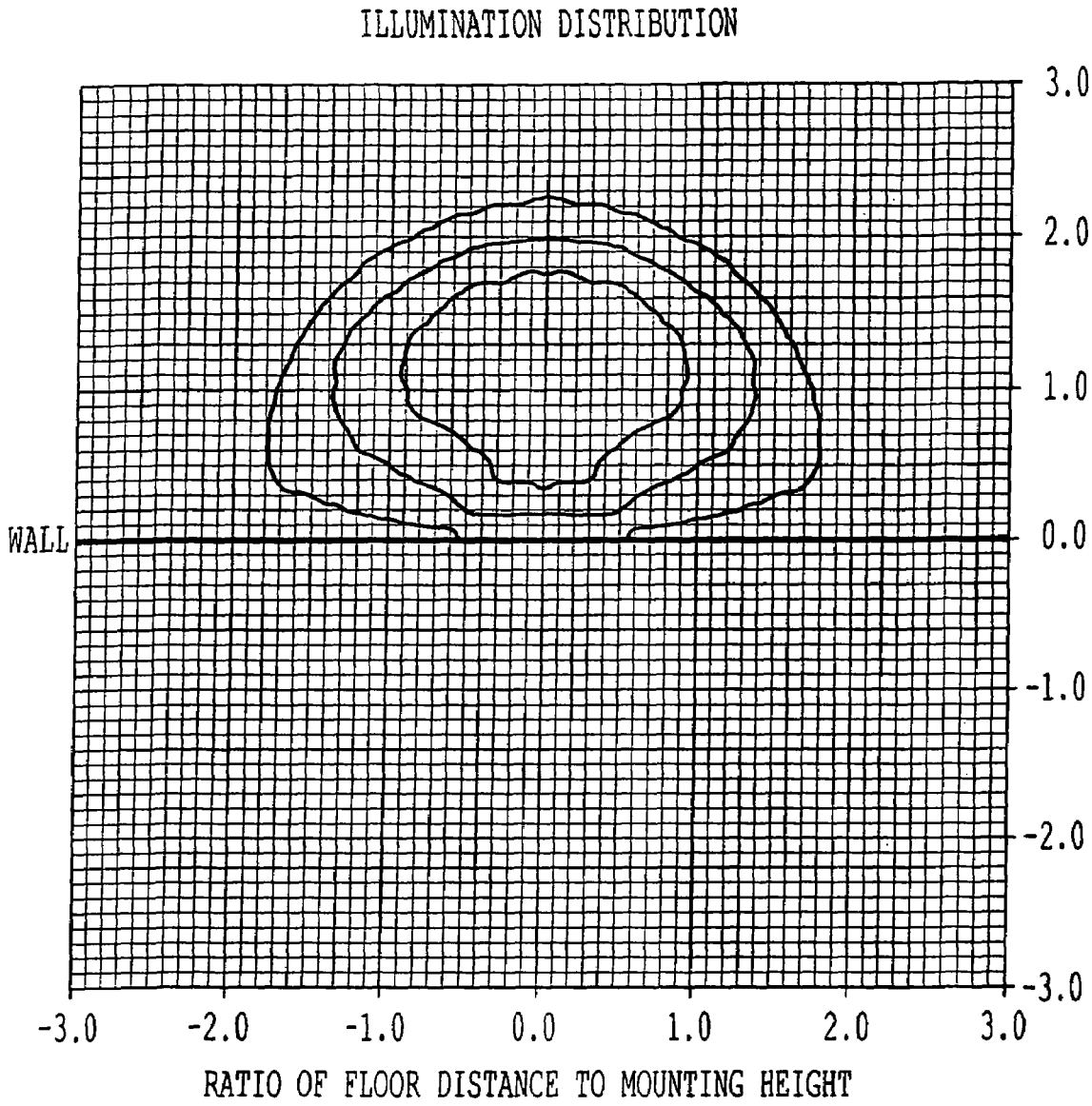
FIG. 5 shows in a chart form an illumination distribution realized by the LED device of FIG. 2.

FIG. 5 shows an example of an output light semicircle shaped illumination distribution for a wall-mounted light using the illumination device 20 of FIG. 2. In FIG. 5 the line 0.0 represents the wall, FIG. 5 showing the illumination distribution with respect to a ratio of floor distance to mounting height. As shown in FIG. 5, a semicircle illumination distribution can be realized by the illumination device 20 such as in FIG. 2 in the present specification, particularly by the reflector 21 satisfying equation (2) above.

Figure 9A:
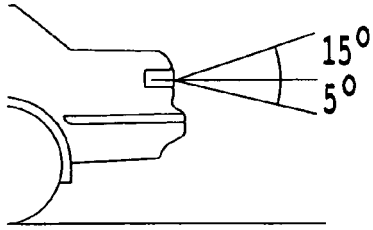
FIGS. 9*a* and 9*b* show an implementation of embodiments of the present invention.
Figure 9B:
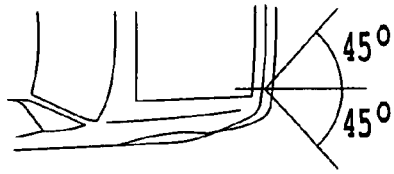

As discussed above, some illumination applications may desire an intensity distribution of output light that is broader in one direction than another. For example, an automotive lighting application such as shown in FIGS. 9*a* and 9*b* may desire a light pattern in a long-and-narrow distribution. In the above-discussed embodiments in FIGS. 2-4 the shape of the different reflectors 21, 31, and 41 can be symmetrical, although non-circular, in the horizontal and vertical axes, and thus those reflectors provide symmetrical non-circular output light intensity distribution. However, by changing the reflecting surfaces of reflectors to have a different curvature in different axes, for example to have a different curvature in the horizontal axis than in the vertical axis, different light intensity distributions can be realized, for example a long-and-narrow light intensity distribution can be output. As shown in FIGS. 9*a*, 9*b* in an automotive tail light, in a vertical direction a 20° total light distribution is output, whereas in a horizontal direction a 90° total light distribution is output, and thereby a long-and-narrow light intensity distribution is output.

Figure 6A:
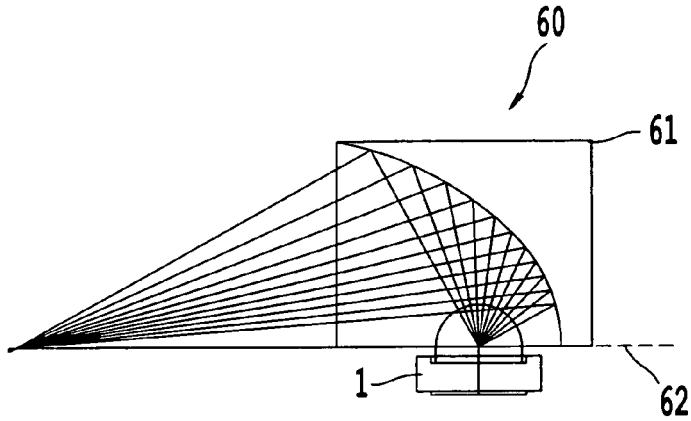
FIGS. 6*a* and 6*b* show an LED illumination device according to a further embodiment of present invention.
Figure 6B:
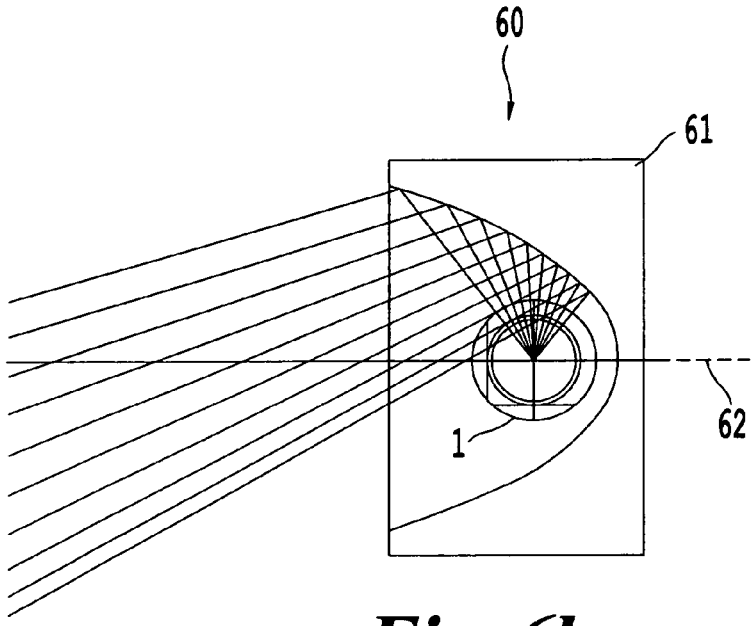

FIGS. 6*a* and 6*b* show a further embodiment of the present invention in which the light intensity distribution is changed in a horizontal axis compared with the vertical axis. FIG. 6*a* shows a side view of an illumination device 60 according to a further embodiment of the present invention including an LED light source 1, a reflector 61, and a central optical axis 62. FIG. 6*a* shows a vertical axis view of the illumination device 60. FIG. 6*b* shows that same reflector 60 from a top view, and thus shows a horizontal axis view. As shown in FIGS. 6*a* and 6*b* the shape of the reflector 61 in the horizontal axis view as shown in FIG. 6*b* differs compared to the shape of the reflector 61 in the vertical axis view as shown in FIG. 6*a*. The curvature of the vertical axis and the curvature of the horizontal axis would blend together at radials between the horizontal and vertical axis. Thereby, in the embodiment of FIGS. 6*a*, 6*b* two different reflective surface portions are offset from each other by 90°. With such a structure the light output of the illumination device 60 can have a long-and-narrow distribution that may be useful in certain environments, as a non-limiting example as an automotive tail lamp such as shown in FIGS. 9*a*, 9*b*.

Further, in the illumination device 60 of FIGS. 6*a* and 6*b* the shapes of the reflector 61 are different in both the horizontal and vertical axis, however both shapes still satisfy equations (1) or (2) noted above, and in that case the conic constant k, curvature c, or arbitrary function F would be changed for each reflector portion. Thereby, the reflector 60 effectively includes first and second reflective portions (in the respective horizontal and vertical axes) that each have a conic or conic-like shape, which differ from each other. Such conic shapes can be reproduced/modified using a set of points in a basic curve such as a spline fit, which results in a conic-like shape for each of the two different reflective portions of the reflector 61.

The embodiment noted above in FIGS. 6*a* and 6*b* shows a reflector 61 having essentially two different curvatures, one in a vertical direction as in FIG. 6*a* and one in a horizontal axis as in FIG. 6*b*.

Figure 7A:
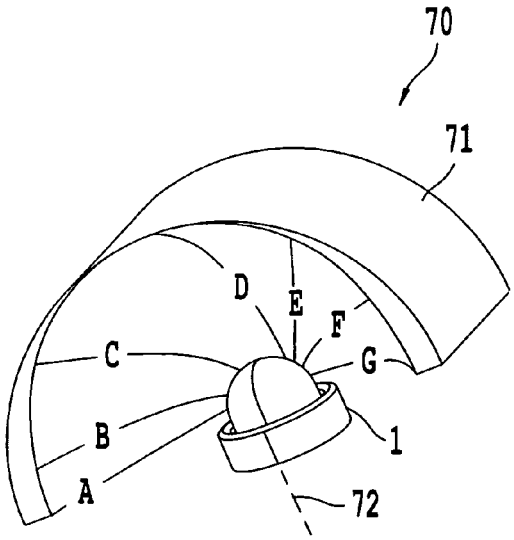
FIGS. 7*a* and 7*b* shown an LED illumination device according to a further embodiment of the present invention.
Figure 7B:
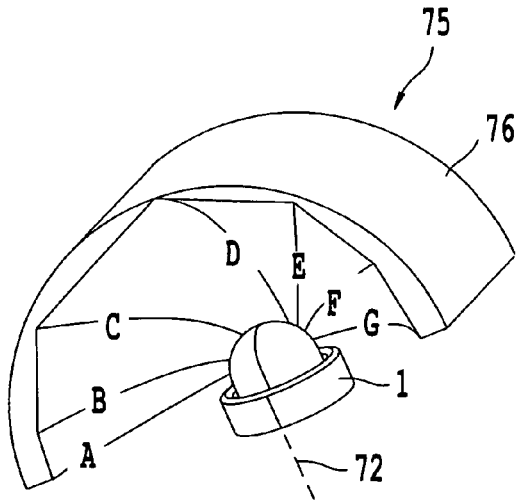

According to a further embodiment of an illumination device of the present invention as shown in FIGS. 7*a* and 7*b*, more than two curvatures can be used for a reflector surface.

FIGS. 7*a* and 7*b* show respective further illumination devices 70 and 75 each including an LED light source 1 and a central optical axis 72. In FIG. 7*a* multiple radially offset curvatures A-G are formed in the reflector 71 at different radial positions of the reflector 71. The different curvatures blend together along the reflector surface. Thereby, a more complicated illumination and intensity profile can be realized.

FIG. 7*b* shows a further illumination device 75 with a reflector 76 similar to reflector 71 in FIG. 7*a*, except that the portions of the curvature of the reflector 76 have segmented or faceted conic-reflector surfaces, similar to the embodiment in FIG. 4. Although in FIG. 4 the reflector is segmented along the curve of the reflector whereas in FIG. 7*b* the reflector is segmented radially. A modified reflector could also combine both types of segmenting from FIGS. 4 and 7*b*.

Also similar to the embodiment of FIGS. 6*a* and 6*b*, each different curvature portion A-G of the reflectors 71, 76 in FIGS. 7*a* and 7*b* can be reproduced/modified using a set of points and a basic curve such as a spline fit, which results in a conic-like shape for the reflectors 71, 76. Again, each curvature portion A-G may satisfy equations (1) or (2) noted above, and in that case the conic constant k, curvature c, or arbitrary function F would be changed for each reflector portion.

Figure 8:
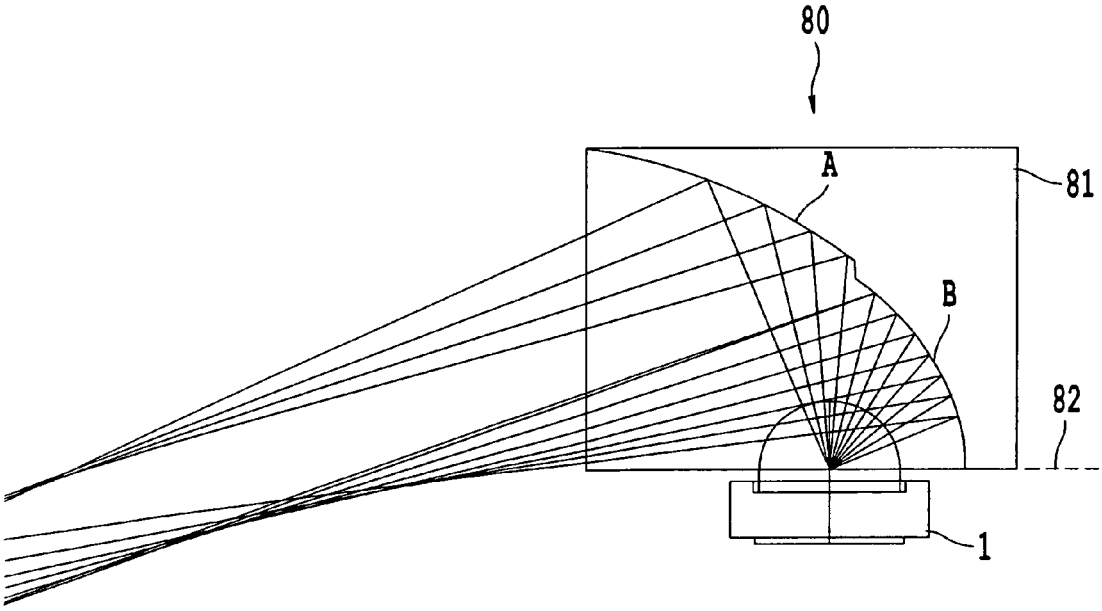
FIG. 8 shows an LED illumination device according to a further embodiment of the present invention.

FIG. 8 shows a further embodiment of an illumination device 80 according to an embodiment of the present invention. That illumination device 80 of FIG. 8 also includes an LED 1 outputting light to a reflector 81, with a similar relationship to an optical axis 82 as in the previous embodiments. In the illumination device 80 in FIG. 8 the reflector 81 along one radial positioning has two different areas A and B with different curvatures each of a conic or conic-like shape. That is, each curvature area A and B may also satisfy equations (1) or (2) above, and in that case each curvature portion A and B will satisfy those formulas with a different conic constant k, curvature c, or arbitrary function F. In that case, the conic shapes can also be reproduced/modified using a set of points and a basic curve such as a spline fit, which again results in a conic-like shape for each area A, B of the reflector 81.

In each of these further embodiments in FIGS. 6-8 noted above a more complicated illumination or intensity distribution output by the illumination devices 60, 70, 75, and 80 can be realized.

Obviously, numerous additional modifications and variations of the present invention are possible in light of the above teachings. It is therefore to be understood that within the scope of the appended claims, the present invention may be practiced otherwise than as specifically described herein.

What is claimed is:

1. An illumination source comprising:

a reflector having at least first and second portions of a reflecting surface, said first portion having a first conic or conic-like shape, and said second portion having a second conic or conic-like shape that differs from the first conic or conic-like shape of said first pattern; and a light-emitting diode LED positioned at approximately 90° with respect to a central axis of the reflector.

2. An illumination source according to claim 1, wherein the conic or conic-like shape reflector has a shape selected from the group consisting of: a hyperbola; a parabola; an ellipse; a sphere; or a modified conic.

3. An illumination source according to claim 1, wherein the conic or conic-like shape reflector includes segmented or faceted surfaces at least one of (1) radially along the reflector or (2) along a radial position of the reflector.

4. An illumination source according to claim 1, wherein the reflector is formed of one of: a metal; a metalized surface; or a reflectorized surface.

5. An illumination source according to claim 1, wherein the reflector is formed of a solid material of plastic or glass that reflects light through total internal reflection.

6. An illumination source according to claim 1, wherein each of said first and second portions of the reflecting surface of the reflector satisfies:

$$z = \frac{cr^2}{1 + \sqrt{1 - (1 + k)c^2r^2}}$$
$$r^2 = x^2 + y^2,$$

in which x, y, and z are positions on a 3-axis system, k is conic constant, and c is curvature.

7. An illumination source according to claim 1, wherein each of said first and second portions of the reflecting surface of the reflector satisfies:

$$z = \frac{cr^2}{1 + \sqrt{1 - (1 + k)c^2r^2}} + F$$
$$r^2 = x^2 + y^2,$$

in which x, y, and z are positions on a 3-axis system, k is conic constant, c is curvature, and F is an arbitrary function.

8. An illumination source according to claim 1, wherein said first and second portions are different portions offset by 90° from each other.

9. An illumination source according to claim 1, wherein said first and second portions are different portions offset radially from each other on the reflecting surface.

10. An illumination source according to claim 1, wherein said first and second portions are different portions along a same radial positioning on the reflecting surface.

11. An illumination source according to claim 1, wherein said first and second conic or conic-like portions are represented by a set of points and a basic curve or a spline fit, resulting in a conic-like shape of said first and second portions of the reflector.

12. An illumination source comprising:

means for reflecting a reflector having at least first and second portions of a reflecting surface, said first portion having a first conic or conic-like shape, and said second portion having a second conic or conic-like shape that differs from the first conic or conic-like shape of said first portion; and a light-emitting diode LED positioned at approximately 90° with respect to a central axis of the means for reflecting.

13. An illumination source according to claim 12, wherein the conic or conic-like shape means for reflecting has a shape selected from the group consisting of: a hyperbola; a parabola; an ellipse; a sphere; or a modified conic.

14. An illumination source according to claim 12, wherein the conic or conic-like shape means for reflecting includes segmented or faceted surfaces at least one of (1) radially along the reflector or (2) along a radial position of the reflector.

15. An illumination source according to claim 12, wherein the means for reflecting is formed of one of: a metal; a metalized surface; or a reflectorized surface.

16. An illumination source according to claim 12, wherein the means for reflecting is formed of a solid material of plastic or glass that reflects light through total internal reflection.

17. An illumination source according to claim 12, wherein each of said first and second portions of the reflecting surface of the reflector satisfies:

$$z = \frac{cr^2}{1 + \sqrt{1 - (1 + k)c^2r^2}}$$
$$r^2 = x^2 + y^2,$$

in which x, y, and z are positions on a 3-axis system, k is conic constant, and c is curvature.

18. An illumination source according to claim 12, wherein each of said first and second portions of the reflecting surface of the reflector satisfies:

$$z = \frac{cr^2}{1 + \sqrt{1 - (1 + k)c^2r^2}} + F$$
$$r^2 = x^2 + y^2,$$

in which x, y, and z are positions on a 3-axis system, k is conic constant, c is curvature, and F is an arbitrary function.

19. An illumination source according to claim 12, wherein said first and second portions are different portions offset by 90° from each other.

20. An illumination source according to claim 12, wherein said first and second portions are different portions offset radially from each other on the reflecting surface.

21. An illumination source according to claim 12, wherein said first and second portions are different portions along a same radial positioning on the reflecting surface.

22. An illumination source according to claim 12, wherein said first and second conic or conic-like portions are represented by a set of points and a basic curve or a spline fit, resulting in a conic-like shape of said first and second portions of the reflector.

* * * * *